US010196233B2

(12) United States Patent
Witczak et al.

(10) Patent No.: US 10,196,233 B2
(45) Date of Patent: Feb. 5, 2019

(54) ELEVATOR SYSTEM ASSIGNING CARS TO FLOOR GROUPS

(71) Applicant: Otis Elevator Company, Farmington, CT (US)

(72) Inventors: Tadeusz Witczak, Lodz (PL); Zbigniew Piech, Cheshire, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 267 days.

(21) Appl. No.: 15/101,135

(22) PCT Filed: Dec. 5, 2013

(86) PCT No.: PCT/US2013/073315

§ 371 (c)(1),
(2) Date: Jun. 2, 2016

(87) PCT Pub. No.: WO2015/084368

PCT Pub. Date: Jun. 11, 2015

(65) Prior Publication Data

US 2016/0297640 A1 Oct. 13, 2016

(51) Int. Cl.
*B66B 1/20* (2006.01)
*B66B 1/24* (2006.01)
(Continued)

(52) U.S. Cl.
CPC ..... *B66B 1/2466* (2013.01); *B66B 1/2491* (2013.01); *B66B 3/002* (2013.01);
(Continued)

(58) Field of Classification Search
CPC ... B66B 1/2466; B66B 1/2491; B66B 3/0002; B66B 11/0407; B66B 9/003;
(Continued)

(56) References Cited

U.S. PATENT DOCUMENTS 5,663,538 A * 9/1997 Sakita ..... B66B 1/2466 187/249
5,865,274 A * 2/1999 Kiji ..... B66B 1/2458 187/249
(Continued)

FOREIGN PATENT DOCUMENTS

CN 1150113 A 5/1997
CN 101875465 A 11/2010
(Continued)

OTHER PUBLICATIONS

International Search Report for application PCT/US2013/073315, dated Sep. 1, 2014, 11 pages.
(Continued)

*Primary Examiner* — Anthony Salata
(74) *Attorney, Agent, or Firm* — Cantor Colburn LLP

(57) ABSTRACT

A ropeless elevator system may include a plurality of elevator cars, a first hoistway, a second hoistway, an upper transfer station, and a lower transfer station. Movement of each of the plurality of elevator cars may be controlled according to a predetermined assignment in which: a plurality of floors is divided into a plurality of floor groups, each of the plurality of elevator cars is assigned to at least one of the plurality of floor groups, and each of the plurality of elevator cars is dispatched only to floors within the at least one floor group assigned thereto.

20 Claims, 9 Drawing Sheets

(51) Int. Cl.
*B66B 11/04* (2006.01)
*B66B 3/00* (2006.01)
*B66B 9/00* (2006.01)

(52) U.S. Cl.
CPC ..... *B66B 11/0407* (2013.01); *B66B 9/003* (2013.01); *B66B 2201/20* (2013.01); *B66B 2201/301* (2013.01); *B66B 2201/405* (2013.01); *B66B 2201/4661* (2013.01)

(58) Field of Classification Search
CPC ..... B66B 2201/20; B66B 2201/405; B66B 2201/4661; B66B 2201/301
USPC ..... 187/247, 249, 380–388, 393, 391, 394
See application file for complete search history.

(56) References Cited

U.S. PATENT DOCUMENTS 5,877,462 A * 3/1999 Chenais ..... B66B 5/0031 187/249
6,871,727 B2 * 3/2005 Jokela ..... B66B 1/18 187/249
6,955,245 B2 * 10/2005 Dunser ..... B66B 1/2466 187/249
7,198,136 B2 * 4/2007 Urata ..... B66B 9/00 187/249
7,360,629 B2 * 4/2008 Hagi ..... B66B 1/2458 187/249
7,487,860 B2 * 2/2009 Hikita ..... B66B 1/2433 187/249
7,537,089 B2 * 5/2009 Duenser ..... B66B 1/2466 187/247
7,621,376 B2 * 11/2009 Duenser ..... B66B 9/00 187/247
7,650,966 B2 1/2010 Sansevero et al.
7,841,450 B2 * 11/2010 Smith ..... B66B 1/18 187/249
8,132,652 B2 * 3/2012 Hakala ..... B66B 1/2458 187/249
8,739,936 B2 * 6/2014 Kostka ..... B66B 1/2433 187/249
2006/0163008 A1 7/2006 Godwin
2006/0175146 A1 8/2006 Hikita
2010/0065378 A1 3/2010 Christy et al.
2010/0282543 A1 11/2010 Hsu et al.

FOREIGN PATENT DOCUMENTS

CN 102153008 A 8/2011
CN 103303769 A 9/2013
EP 1733990 A1 12/2006
WO 2005044708 A1 5/2005
WO 2012154178 A1 11/2012

OTHER PUBLICATIONS

Chevailler, S., et al., "Linear Motors for Multi Mobile Systems", IEEE Industrial Applications Conference Fortieth IAS Annual Meeting, Oct. 2, 2005, pp. 2099-2106.
Chinese First Office Action and Search Report for application CN 201380082016.5, dated Jul. 13, 2017, 7pgs.
European Search Report for application EP 13898607.0, dated Jul. 11, 2017, 9pgs.

* cited by examiner

ELEVATOR SYSTEM ASSIGNING CARS TO FLOOR GROUPS

FIELD OF THE DISCLOSURE

The present disclosure relates generally to elevators and, more particularly, to self-propelled elevator systems.

BACKGROUND OF THE DISCLOSURE

Self-propelled elevator systems, in some instances referred to as ropeless elevator systems, are useful in certain applications, such as, high rise buildings, where the mass of the ropes for a conventional roped elevator system is prohibitive and it is beneficial to have multiple elevator cars in a single shaft. In self-propelled elevator systems, a first hoistway is designated for upward travel of the elevator cars, and a second hoistway is designated for downward travel of the elevator cars. In addition, transfer stations are used to move the elevator cars horizontally between the first and second hoistways.

SUMMARY OF THE DISCLOSURE

An exemplary embodiment of the present invention is directed to a ropeless elevator system. The exemplary ropeless elevator system may comprise a plurality of elevator cars, a first hoistway configured to allow upward travel of the plurality of elevator cars, a second hoistway configured to allow downward travel of the plurality of elevator cars, an upper transfer station proximate a top of the first hoistway and the second hoistway, and a lower transfer station proximate a bottom of the first hoistway and the second hoistway. Each of the plurality of elevator cars may be moveable between the first hoistway and the second hoistway by way of each of the upper transfer station and the lower transfer station. Movement of each of the plurality of elevator cars may be controlled according to a predetermined assignment in which: a plurality of floors is divided into a plurality of floor groups, each of the plurality of elevator cars is assigned to at least one of the plurality of floor groups, and each of the plurality of elevator cars is dispatched only to floors within the at least one floor group assigned thereto.

According to another exemplary embodiment, a method for dispatching a plurality of elevator cars in an elevator system is disclosed. The elevator system may have a first hoistway configured to allow upward travel of the plurality of elevator cars, a second hoistway configured to allow downward travel of the plurality of elevator cars, an upper transfer station proximate a top of the first hoistway and the second hoistway, a lower transfer station proximate a bottom of the first hoistway and the second hoistway, and a control system communicating with a control unit positioned in each of the plurality of elevator cars. Each of the plurality of elevator cars may be moveable between the first hoistway and the second hoistway by way of each of the upper transfer station and the lower transfer station. The method may comprise dividing a plurality of floors into a plurality of floor groups, assigning each of the plurality of elevator cars to at least one of the plurality of floor groups, and dispatching each of the plurality of elevator cars only to floors within the at least one floor group assigned thereto.

According to another exemplary embodiment, a ropeless elevator system is disclosed. The ropeless elevator system may comprise an elevator car circulating in a loop to a plurality of floors. The loop may include a first hoistway in which the elevator car travels upward, a second hoistway in which the elevator car travel downward, an upper transfer station positioned above the first hoistway and the second hoistway, and a lower transfer station positioned below the first hoistway and the second hoistway, the elevator car moveable between the first hoistway and the second hoistway when disposed in the upper or lower transfer station. The ropeless elevator system may further comprise a control unit mounted on the elevator car, and a control system in communication with the control unit. The control system may be programmed to assign the elevator car to a first group of floors according to a first assignment, send instructions to the control unit to dispatch the elevator car to the first group of floors, re-assign the elevator car to a second group of floors according to a second assignment, and send instructions to the control unit to dispatch the elevator car to the second group of floors.

Although various features are disclosed in relation to specific exemplary embodiments, it is understood that the various features may be combined with each other, or used alone, with any of the various exemplary embodiments without departing from the scope of the disclosure. For example, the predetermined assignment may be dynamic. The predetermined assignment may comprise an initial assignment and at least one subsequent assignment. Each of the plurality of elevator cars may have a control unit in communication with a control system, the control system programmed to dynamically assign each elevator car for dispatching. The ropeless elevator system may further comprise at least one indicator that informs passengers which floors each of the plurality of elevator cars is assigned to. The indicator may be selected from the group consisting of a display, a computer screen, a touchscreen, a tablet, a colored LED, an electronic sign, and an audio message.

In another example, the plurality of elevator cars comprises at least one special purpose car. Each elevator car may include a control unit, in communication with a control system to dispatch the plurality of elevator cars, each elevator car may be statically assigned to the predetermined assignment, and the control unit may communicate to the control system the predetermined assignment. The predetermined assignment may include a first elevator car assigned to stop at upper floors, and a second elevator car assigned to stop at lower floors.

These and other aspects and features will become more readily apparent upon reading the following detailed description when taken in conjunction with the accompanying drawings.

While the present disclosure is susceptible to various modifications and alternative constructions, certain illustrative embodiments thereof will be shown and described below in detail. The invention is not limited to the specific embodiments disclosed, but instead includes all modifications, alternative constructions, and equivalents thereof

DETAILED DESCRIPTION

Figure 1:
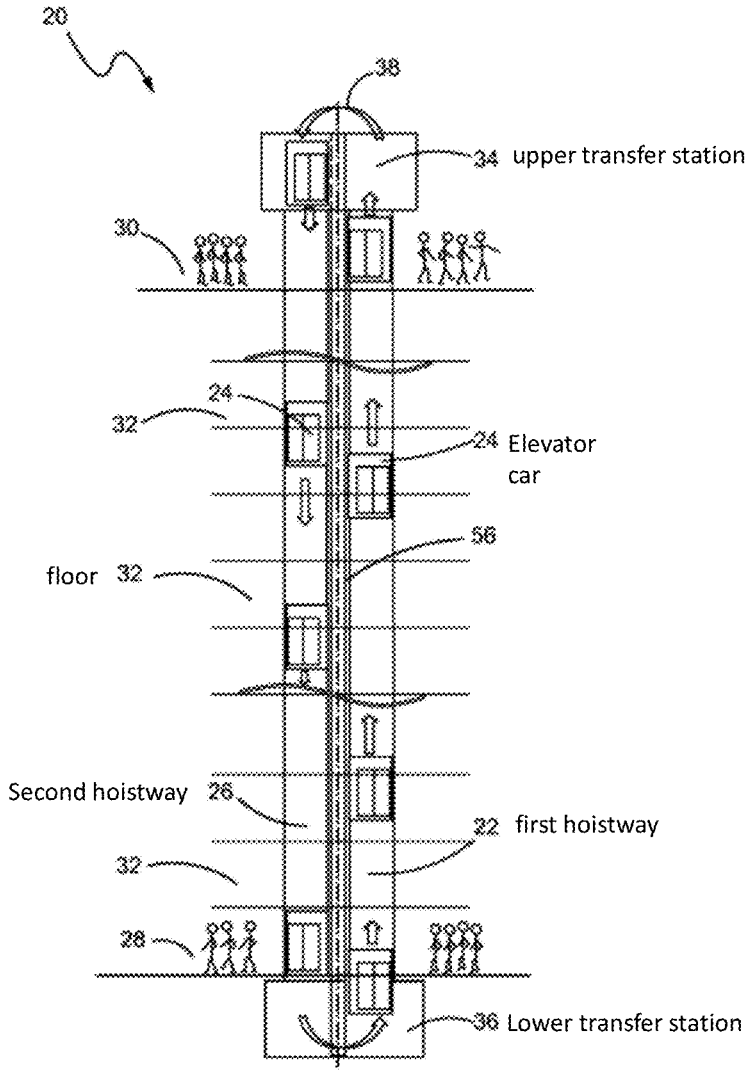
FIG. 1 depicts an elevator system according to an exemplary embodiment.
Figure 2:
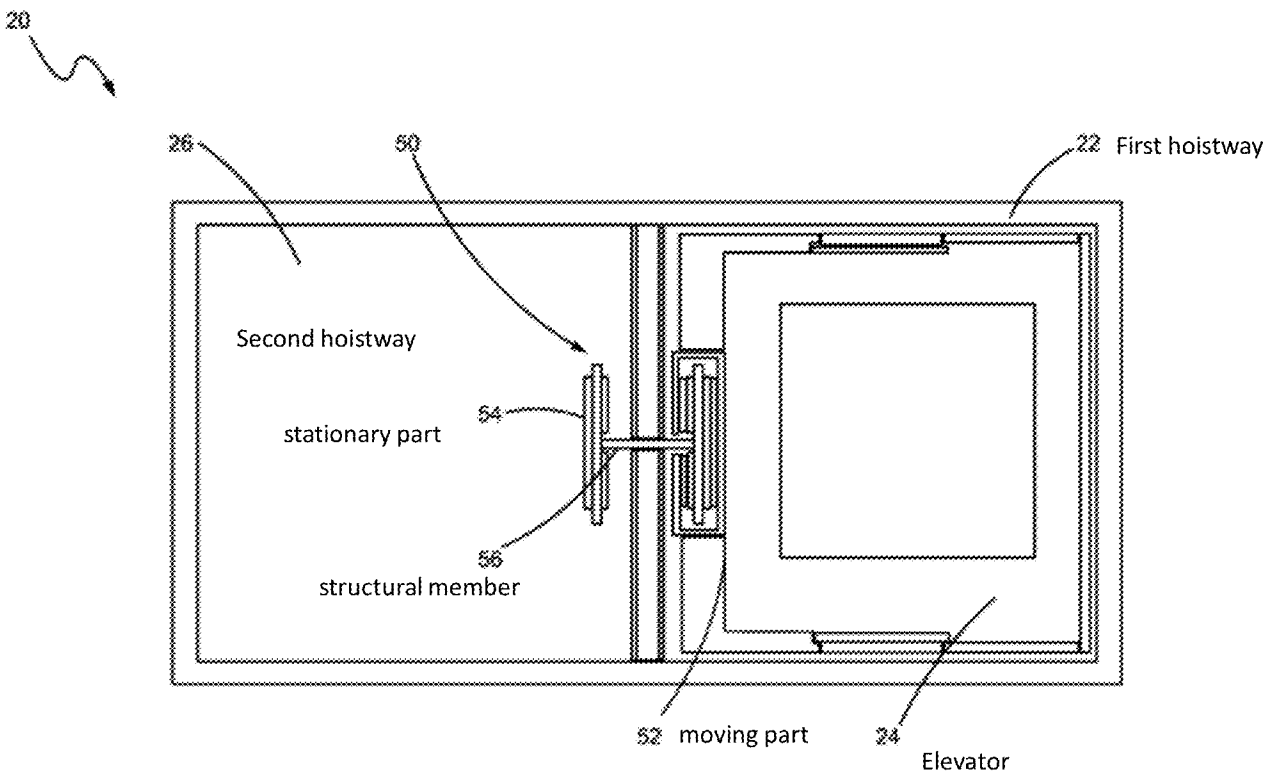
FIG. 2 is a top down view of an elevator car in a hoistway in an exemplary embodiment.
Figure 4:
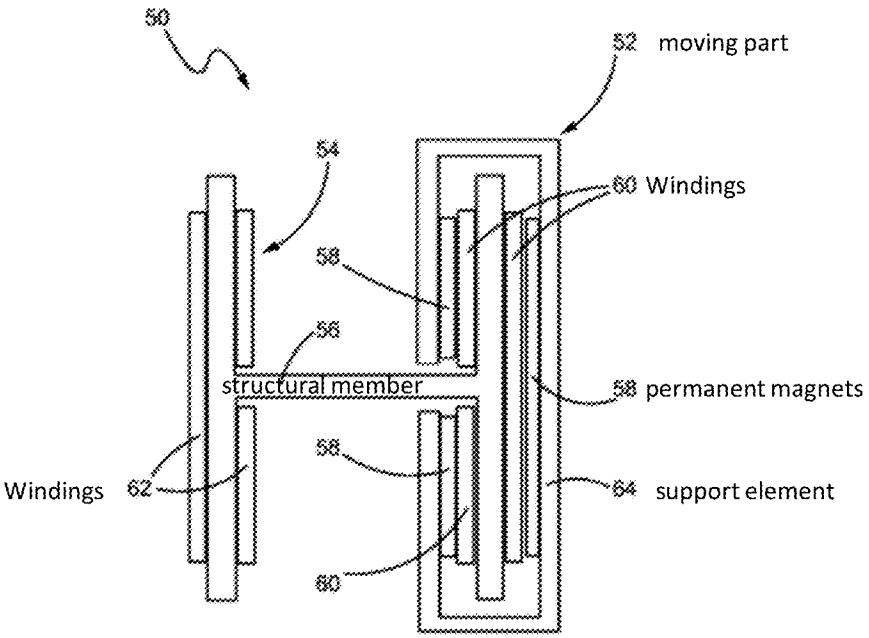
FIG. 4 is a top down view of a stationary portion and a moving portion of a propulsion system in an exemplary embodiment.
Figure 3:
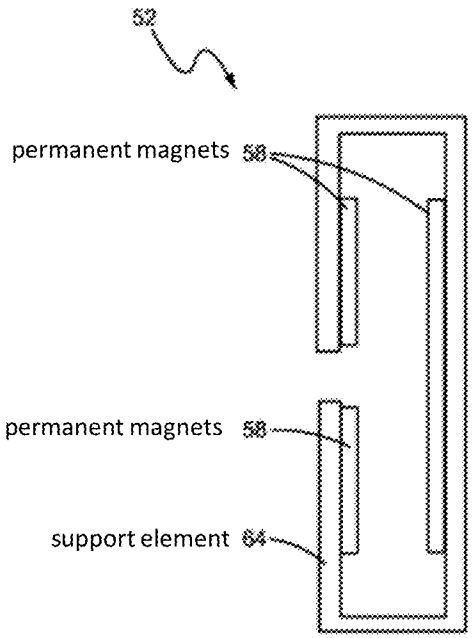
FIG. 3 is a top down view of a moving portion of a propulsion system in an exemplary embodiment.
Figure 5:
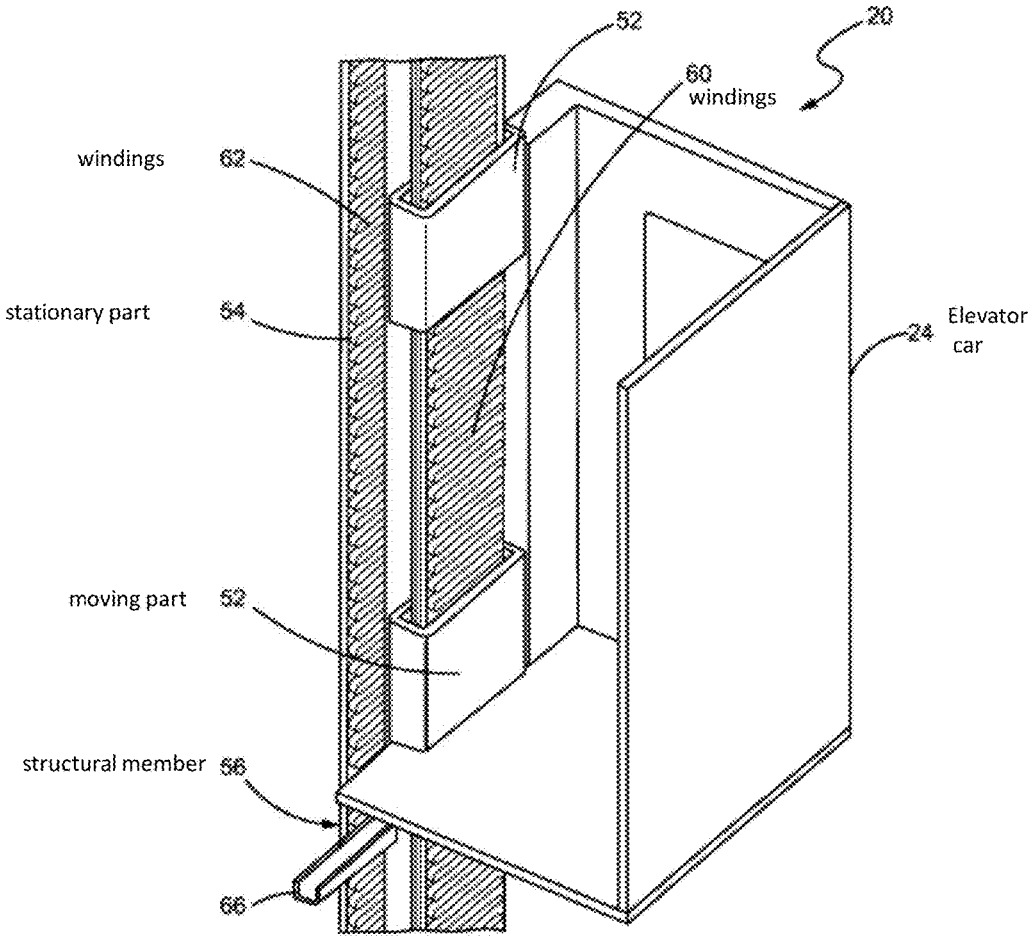
FIG. 5 is a perspective view of an elevator car and a propulsion system in an exemplary embodiment.

FIG. 1 depicts an elevator system 20 in an exemplary embodiment. This elevator system 20 is shown for illustrative purposes to assist in disclosing various embodiments of the invention. As is understood by a person skilled in the art, FIG. 1 does not depict all of the components of an exemplary elevator system, nor are the depicted features necessarily included in all elevator systems.

As shown in FIG. 1, the elevator system 20 includes a first hoistway 22 in which a plurality of elevator cars 24 travel upward and a second hoistway 26 in which the plurality of elevator cars 24 travel downward. Elevator system 20 transports elevator cars 24 from a first floor 28 to a top floor 30 in first hoistway 22, and transports elevator cars 24 from the top floor 30 to the first floor 28 in second hoistway 26. Although not shown, elevator cars 24 may also stop at intermediate floors 32 to allow ingress to and egress from an elevator car intermediate the first floor 28 and top floor 30.

Positioned across the first and second hoistways 22, 26 above the top floor 30 is an upper transfer station 34. Upper transfer station 34 imparts horizontal motion to elevator cars 24 to move the elevator cars 24 from the first hoistway 22 to the second hoistway 26. It is understood that upper transfer station 34 may be located at the top floor 30, rather than above the top floor 30. Positioned across the first and second hoistways 22, 26 below the first floor 28 is a lower transfer station 36. Lower transfer station 36 imparts horizontal motion to elevator cars 24 to move the elevator cars 24 from the second hoistway 26 to the first hoistway 22. It is to be understood that lower transfer station 36 may be located at the first floor 28, rather than below the first floor 28.

Together, the first hoistway 22, the upper transfer station 34, the second hoistway 26, and the lower transfer station 36 comprise a loop 38 in which the plurality of cars 24 circulate to the plurality of floors 28, 30, 32 and stop to allow the ingress and egress of passengers to the plurality of floors 28, 30, 32.

Turning now to FIGS. 2-5, with continued reference to FIG. 1, elevator system 20 includes a propulsion system 50 disposed on the elevator cars 24, in the hoistways 22, 26, and in the transfer stations 34, 36, 42. The propulsion system 50 imparts vertical motion to elevator cars 24 to propel the elevator cars from one level to the next within the hoistways 22, 26 and into and out of the transfer stations 34, 36, 42. Different types of motors can be used for the propulsion system 50, such as, but not limited to, a linear permanent magnet motor, a flux switching motor, an induction motor, a friction motor, or the like. The propulsion system 50 may comprise a moving part 52 mounted on each elevator car 24 and a stationary part 54 mounted to a structural member 56 positioned within the hoistways 22, 26 and transfer stations 34, 36, 42. The interaction of the moving part 52 and the stationary part 54 generates a thrust force to move the elevator cars 24 in a vertical direction within the hoistways 22, 26 and transfer stations 34, 36, 42.

In an example, the moving part 52 includes permanent magnets 58, and the stationary part 54 includes windings 60, 62 mounted on structural member 56. Permanent magnets 58 may be attached to a support element 64 of the moving part 52, with the support element 64 coupled to the elevator car 24. Structural member 56 may be made of a ferromagnetic material and coupled to a wall of the first and/or second hoistways 22, 26 by support brackets 66. Windings 60, 62 may be formed about structural member 56. Windings 60 provide the stationary part of the propulsion system within the first hoistway 22, and windings 62 provide the stationary part of the propulsion system within the second hoistway 26. A support element 64 of the moving part 52 may be positioned about windings 60, 62 such that the windings 60, 62 and permanent magnets 58 are adjacent.

Windings 60 in the first hoistway 22 are energized by a power source (not shown) to propel one or more elevator cars 24 upward in the first hoistway 22 and transfer stations 34, 36, 42. When a voltage is applied to windings 60, the interaction between the windings 60 and permanent magnets 58 impart motion to the elevator car 24. Windings 62 in the second hoistway 26 operate as a regenerative brake to control descent of the elevator car 24 in the second hoistway 26 and transfer stations 34, 36, 42. Windings 62 also provide a current back to the drive unit, for example, to recharge an electrical system.

Figure 6:
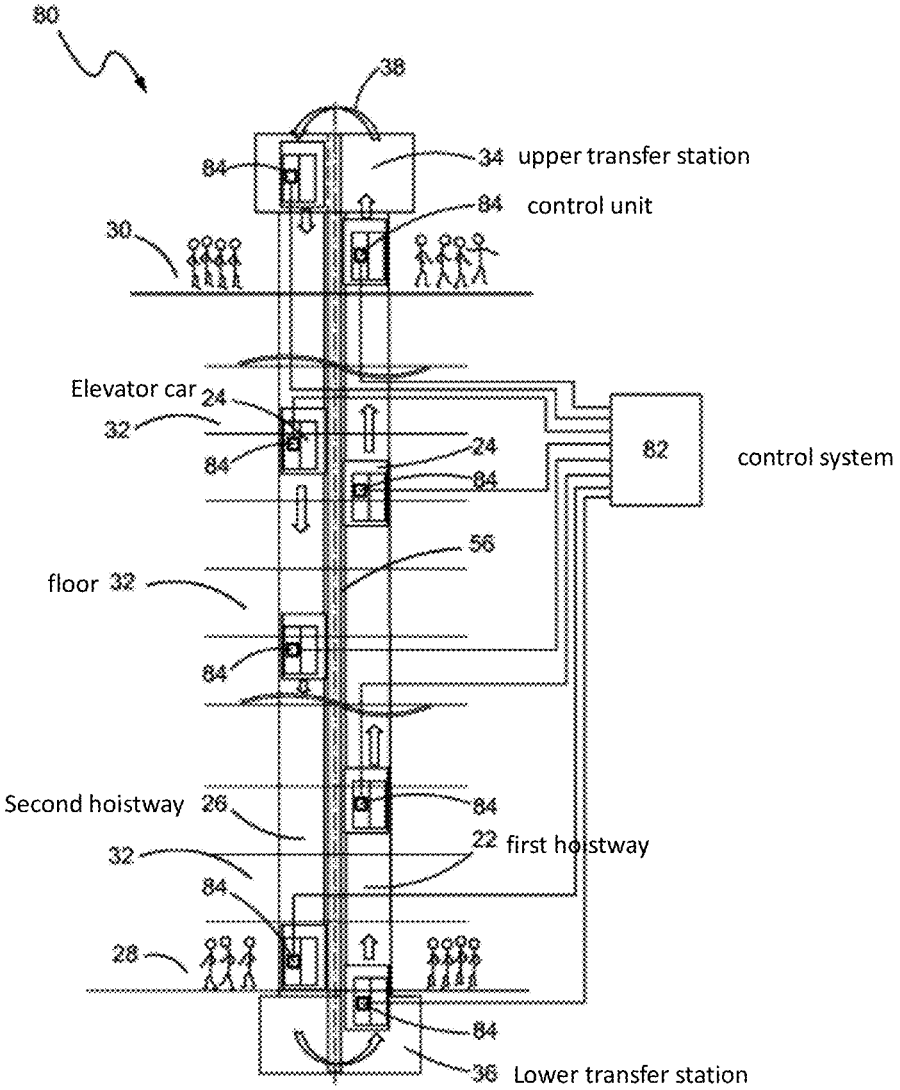
FIG. 6 depicts another elevator system in an exemplary embodiment.

Referring now to FIG. 6, with continued reference to FIGS. 1-5, therein is illustrated an elevator system 80 in another exemplary embodiment. Elements of FIG. 6 corresponding to elements in FIG. 1 are labeled with the same reference numerals where practicable. As shown schematically in FIG. 6, elevator system 80 includes a control system 82 in communication with a control unit 84 mounted on each of the elevator cars 24. The control system 82 and control units 84 may comprise a processor (e.g., "computer processor") or processor-based device that may include or be associated with a non-transitory computer readable storage medium having stored thereon computer-executable instructions. It is to be understood that the control system 82 and control units 84 may include other hardware, software, firmware, or combinations thereof.

The control system 82 and control units 84 are configured to control dispatching of the elevator cars 24 to the plurality of floors 28, 30, 32. Algorithms or sets of instructions for dispatching the elevator cars 24 around the loop 38 may be programmed into a memory of the control system 82 and/or control units 84. The control system 82 may be located in a building where the elevator system 80 is located, a remote location away from the elevator system 80, or a cloud-based system. The control system 82 may communicate with the control units 84 in each of the elevator cars through wired or wireless connections, such as, without limitation, cables, the Global System for Mobile Communications (GSM), Wi-Fi, or the like.

In an exemplary embodiment, the elevator cars 24 are designated for circulation around the loop 38 according to a predetermined assignment. The predetermined assignment is a planned arrangement for dispatching the elevator cars 24 around the loop 38 to the plurality of floors 28, 30, 32, that is programmed into the control system 82 and control units 84. The predetermined assignment includes the plurality of floors 28, 30, 32 being divided into different groups, and each group of floors assigned to one or more elevator cars 24. The predetermined assignment can be programmed into the memory of the control system 82 and/or control units 84 of the elevator cars 24. The control system 82 and control unit 84 of each elevator car 24 communicate with each other the predetermined assignment to effectively dispatch the elevator cars 24 within the loop 38, stopping at only the floors of the group to which it is assigned.

Figure 7:
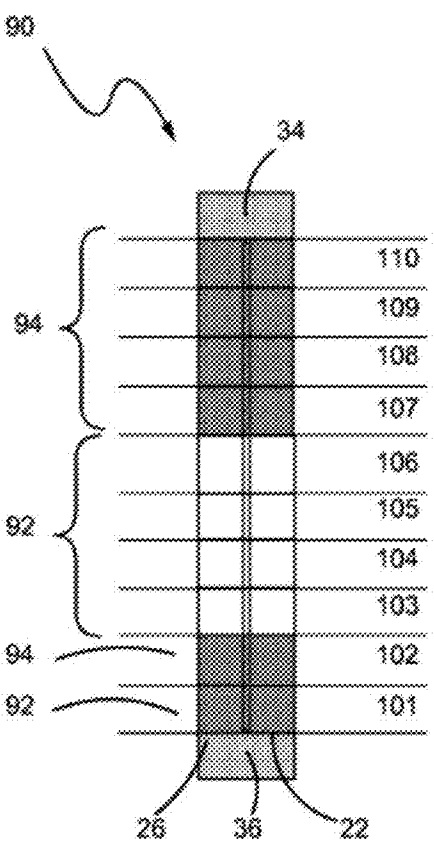
FIG. 7 is a schematic representation of a predetermined assignment in an exemplary embodiment.

As shown best in FIG. 7, one example for a predetermined assignment 90 may comprise dividing the plurality of floors into two groups, such as a first group of floors 92 and a second group of floors 94. The first group of floors 92 may include a lower lobby 101 and lower floors 103-106, while the second group of floors 94 may include an upper lobby 102 and upper floors 107-110. One or more elevator cars may be assigned to the first group of floors 92 such that those elevator cars travel around the loop 38 only stopping at lower lobby 101 and lower floors 103-106. Other elevator cars may be assigned to the second group of floors 94 such that those elevator cars travel around the loop 38 only stopping at upper lobby 102 and upper floors 107-110.

Figure 8:
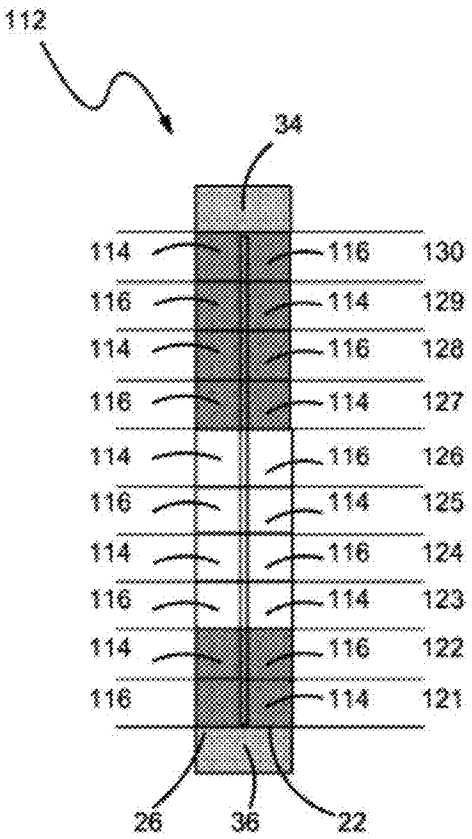
FIG. 8 is a schematic representation of another predetermined assignment in an exemplary embodiment.

As shown best in FIG. 8, another example for a predetermined assignment 112 may comprise dividing the plurality of floors into two groups with assigned floors according to the hoistway. For instance, a first group of floors 114 may include odd-numbered floors 121, 123, 125, 127, 129 in the first hoistway 22 and even-numbered floors 122, 124, 126, 128, 130 in the second hoistway 26. A second group of floors 116 may include even-numbered floors 122, 124, 126, 128, 130 in the first hoistway 22 and odd-numbered floors 121, 123, 125, 127, 129 in the second hoistway 26. One or more elevator cars can be assigned to the first group 114, travelling around the loop 38 to stop at only the assigned floors 121, 123, 125, 127, 129 on the way up in the first hoistway 22 and floors 130, 128, 126, 124, 122 on the way down in the second hoistway 26. Other elevator cars may be assigned to the second group 116, travelling around the loop 38 to stop at only the assigned floors 122, 124, 126, 128, 130 on the way up in the first hoistway 22 and floors 129, 127, 125, 123, 121 on the way down in the second hoistway 26.

It is to be understood that more or fewer floors than that shown and described in FIGS. 7 and 8 may be incorporated into the predetermined assignments 90, 112. Different planned arrangements for the predetermined assignments, other than that shown and described in FIGS. 7 and 8, may also be applicable. By skipping certain floors and only stopping at the assigned floors, the elevator cars 24 can reach higher speeds between stops, thereby decreasing a travel time of the elevator cars 24 around the loop 38 and increasing dispatching efficiency. This increase in dispatching efficiency can be accomplished within a single loop 38, which does not require more than one upward hoistway or more than one downward hoistway, thereby reducing a hoistway surface footprint within a building of the elevator system.

In addition, in buildings which house two or more separate entities (e.g., hotels, businesses, or residences), there are benefits to having a predetermined assignment which uses separate elevator cars assigned only to the floors of the separate entities. For example, in FIG. 7, a first hotel may own the first group of floors 92, and a second hotel may own the second group of floors 94, with the first hotel and the second hotel residing in a same building. By having this predetermined assignment in the elevator loop 38 of the building, guests of the first hotel do not share elevator cars with guests of the second hotel, nor will guests of the first hotel be able to enter floors of the second hotel (and vice versa). This can also be accomplished within a single loop 38 of the elevator system, thereby reducing a hoistway surface footprint in the building.

The assignment of elevator cars 24 and groups of floors may be static or dynamic. In a static assignment, the floor(s) each elevator car is assigned to does not change, unless manually modified by authorized personnel. If the elevator cars are statically assigned, then the control unit 84 of each elevator car 24 may communicate to the control system 82 the predetermined assignment, and the control system 82 can dispatch the elevator cars 24 only according to that assignment.

In a dynamic assignment, the floor(s) each elevator car is assigned to does change depending on the needs of the elevator system. Each elevator car may be assigned according to a first assignment and later re-assigned according to subsequent assignments. For example, elevator cars may be designated according to the predetermined assignment 90 in FIG. 7, then at a later time, the elevator cars may be designated according to the predetermined assignment 112 in FIG. 8. The control system 82 may be programmed to dynamically assign each elevator car for dispatching to at least one floor, communicating to each of the control units 84 in the elevator cars 24 the assignment and later re-assignment(s) of the floors.

Figure 9:
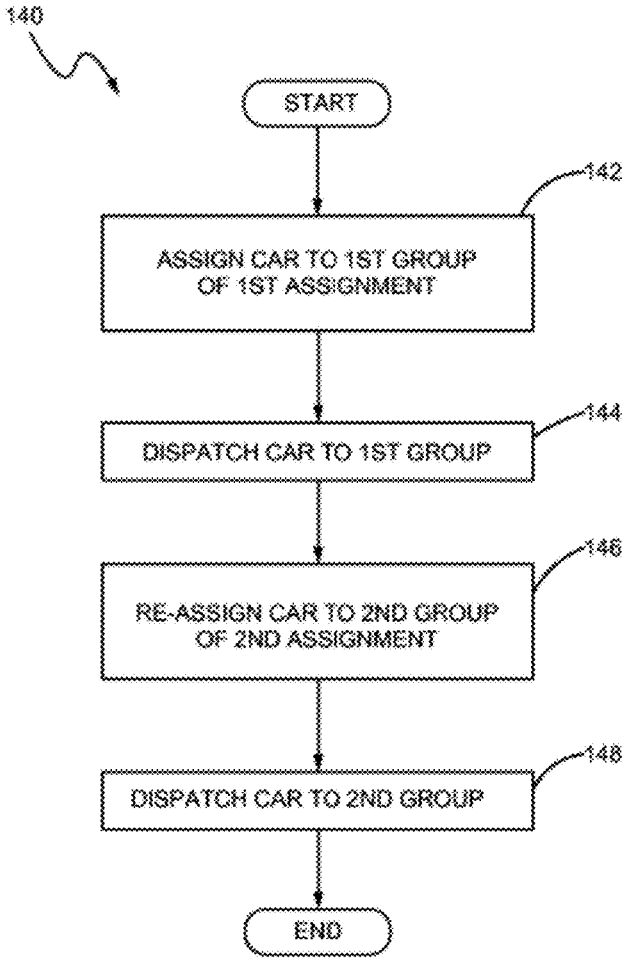
FIG. 9 is a flowchart illustrating an exemplary process of a control system of an elevator system in an exemplary embodiment.

As shown best in the flowchart of FIG. 9, illustrating an exemplary process 140, the control system 82 may be programmed to, at block 142, assign an elevator car 24 to a first group of floors according to a first assignment. At block 144, the control system 82 sends instructions to a control unit 84 of the elevator car 24 to dispatch the elevator car 24 to the first group of floors. At block 146, the control system 82 re-assigns the elevator car 24 to a second group of floors according to a second assignment. At block 148, the control system sends instructions to the control unit 84 to dispatch the elevator car 24 to the second group of floors.

Figure 10:
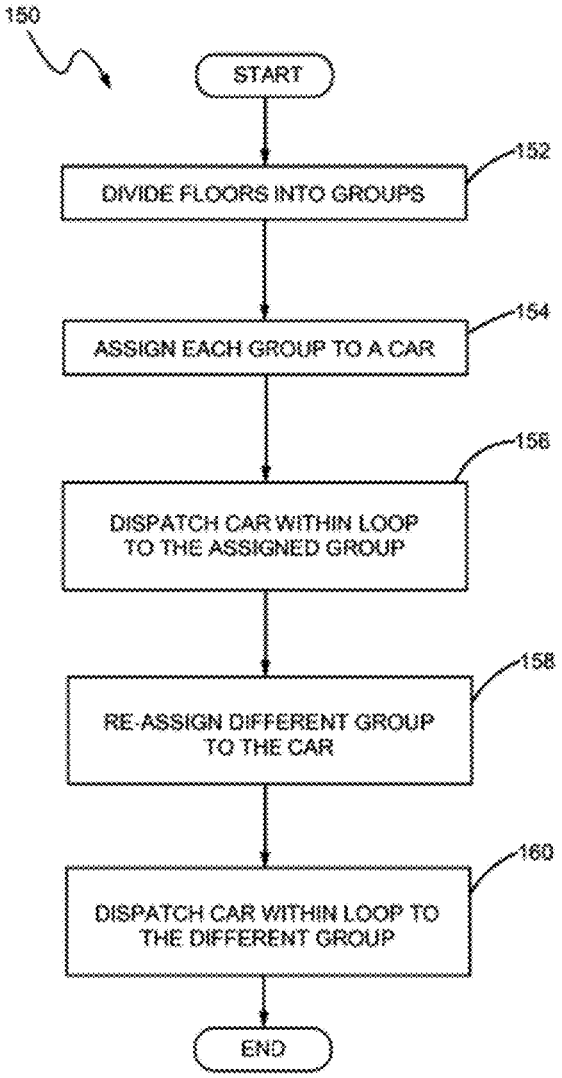
FIG. 10 is a flowchart illustrating an exemplary process for dispatching a plurality of elevator cars in an elevator system in an exemplary embodiment.

The flowchart of FIG. 10 illustrates an exemplary process 150 for dispatching the plurality of elevator cars 24 in the elevator system 80. At block 152, the control system 82 divides the plurality of floors into groups. At block 154, the control system 82 assigns each group to at least one elevator car 24. The control system 82 dispatches the elevator car 24 within the loop 38 to travel to the assigned group of floors at block 156. At block 158, the control system 82 re-assigns a different group of floors to the elevator car 24. The control system 82 dispatches the elevator car 24 within the loop 38 to travel to the different group of floors at block 160.

Dynamic assignment of the elevator cars when travelling within the loop 38 provides efficient dispatching to accommodate needs of a building. For example, a usage pattern of the elevator system during different times of the day and an approximate number of passengers using the elevator system at each of the floors can be determined. Based off of this information, the elevator cars 24 can be assigned according to a first assignment during one time period of the day (e.g., in the morning), and then later re-assigned according to a second assignment during another time period of the day (e.g., in the afternoon). The elevator cars 24 are dispatched to accommodate the fluctuating ingress and egress of passengers to and from specific floors, thereby drastically reducing waiting time for the elevator cars, as well as travel time. Again, this can be accomplished with multiple elevator cars 24 within a single loop 38, thereby reducing a hoistway surface footprint in the building.

Figure 11:
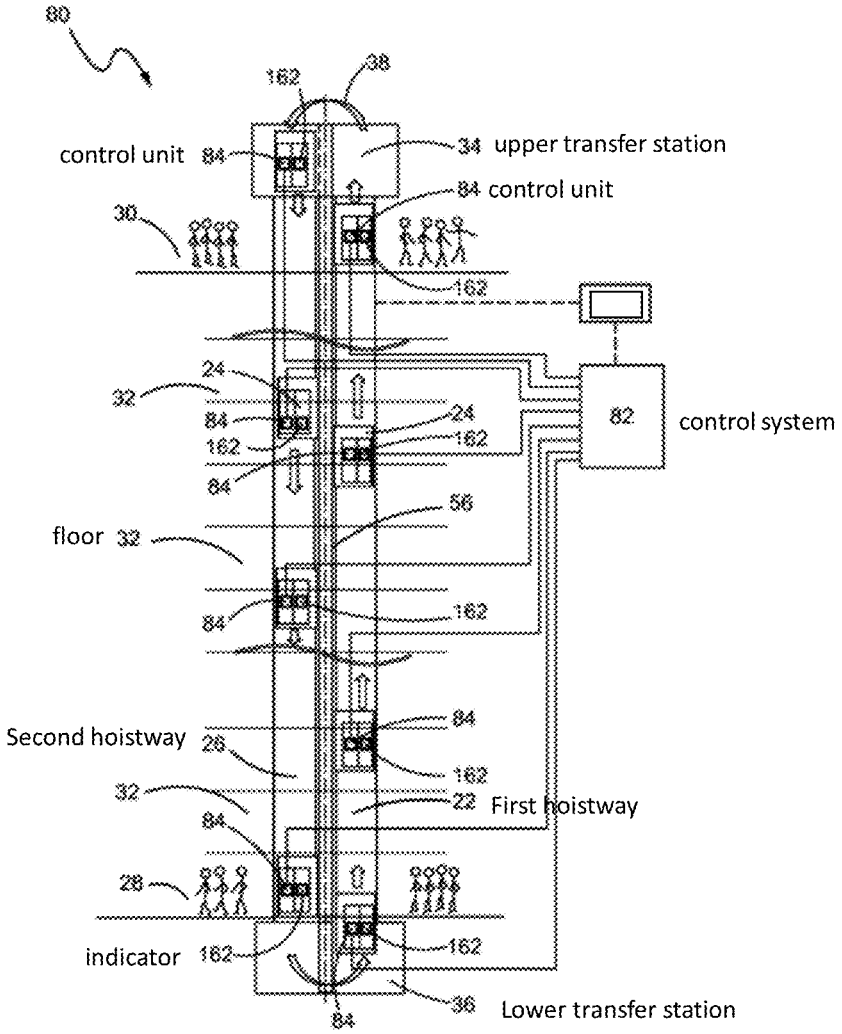
FIG. 11 depicts an elevator system in an exemplary embodiment.

In another exemplary embodiment shown best in FIG. 11, elevator system 80 may further include an indicator 162 mounted on or disposed within each of the elevator cars 24 and/or each of the floors. In communication with the control system 82 and the control units 84 of the elevator cars 24, the indicator 162 conveys information to passengers of the group of floors the elevator car is assigned to. If the elevator cars are dynamically assigned, the indicators 162 can change the information it conveys to passengers when the elevator car 24 is re-assigned to a subsequent group of floors according to a subsequent assignment.

Indicator 162 may comprise a label or sign informing passengers which floors the elevator car 24 is assigned to stop at. For example, the indicator 162 may be a display, a computer screen, a touchscreen, a tablet, a colored LED, an electronic sign, an audio message, or a combination thereof. In the example of a colored LED, if the floors are divided into two groups, a first group and a second group, the elevator cars that are assigned to the first group may have a blue LED and the elevator cars that are assigned to the second group may have a red LED. There may be a further indicator within the elevator system telling passengers which elevator to take, red or blue, depending on which floor is there destination. Thus, when the passengers are waiting for an elevator, when doors of an elevator car open, they will know whether or not to take that specific elevator car based on the illuminated color transmitted by the LED within an interior compartment of the elevator car.

In another exemplary embodiment, at least one of the elevator cars 24 may be assigned as a special car. As used herein, the term "special car" refers to an elevator car designated for a particular purpose, e.g., very important person (VIP) service or cargo service. For example, the special car may be assigned as a VIP car, a cargo car, or any other special purpose car. The VIP car may be empty of other passengers when called and may travel directly to a desired destination floor without having to stop at other floors. Passengers of the VIP car may have access to certain floors, lobbies, or hoistway entrances and exits not accessible to other passengers. Passengers of the cargo car may have access to floors including services, such as, kitchens, storage spaces, laundry rooms, and garages, which may usually not be part of the predetermined assignment. The special car may have a different façade than the other elevator cars 24. For example, the VIP car may be elaborately decorated, and the cargo car may have metal interior walls for simple cleaning procedures.

The control system 82 and/or control unit 84 of the special car may identify calls for the special car and dispatch the special car to the location of the call. For example, the special car can be circulating around the loop 38, and then dispatched to stop at a certain floor when called by a passenger authorized to use the special car (e.g., special guests, managers, service workers, etc.) The authorized passenger may enter an access code or identification card into an input device, in communication with the control system 82 and/or control units 84, located in the elevator lobby. After receiving signals from the input device, the special car may be dispatched to the floor where the authorized passenger called the car.

In another example, passengers located in special floors or lobbies designated for use with special cars only, may call the special car through an input device located in the special floor or lobby. The input device in the special floor or lobby may be configured to automatically call the special car without verifying the passenger's authorization. The control system 82 then dispatches the special car to the special floor or lobby without verification of passenger authorization.

In a static assignment, the special car may circulate around the loop only stopping when called by authorized passengers or when called from a special floor or lobby. In a dynamic assignment, any one of the elevator cars that is empty at the time of the call may be changed from a previous assignment to an assignment as the special car. Then after the particular purpose is achieved and the special car is empty again or no longer in use, the special car assignment may be changed back to the previous assignment. When passengers enter the special car, the passenger may decide which floor to access through an input/output device or indicator disposed within the special car and connected to the control system 82 and control unit 84 of the special car. The indicator, which conveys to passengers which floors the special car is assigned to, may be changed when the special car is called or the passenger selects the desired destination floor.

By assigning at least one elevator car 24 as the special car, passengers can control which floors to directly travel to, even having access to special floors or lobbies of a building not accessible by other passengers. A designated special car can decrease wait times and travel times of its passengers, as well as the other elevator cars 24, because it is not part of the main traffic flow. This is all accomplished within the same loop 38 that is used by the other elevator cars 24, without requiring an added special hoistway, thereby reducing a hoistway surface footprint in the building.

By using the elevator systems and methods disclosed herein, simplified traffic management and dispatching efficiency is achieved. By assigning each elevator car to a specific group of floors, dynamically re-assigning the elevator cars to a different group of floors, or designating a special car, travel time within the elevator system is reduced. Furthermore, this can be accomplished with multiple elevator cars travelling within a loop, thereby reducing a hoistway surface footprint of the elevator system in a building.

While the foregoing detailed description has been given and provided with respect to certain specific embodiments, it is to be understood that the scope of the disclosure should not be limited to such embodiments, but that the same are provided simply for enablement and best mode purposes. The breadth and spirit of the present disclosure is broader than the embodiments specifically disclosed and encompassed within the claims appended hereto.

While some features are described in conjunction with certain specific embodiments of the invention, these features are not limited to use with only the embodiment with which they are described, but instead may be used together with or separate from, other features disclosed in conjunction with alternate embodiments of the invention.

What is claimed is:

1. A ropeless elevator system comprising:

a plurality of elevator cars;

a first hoistway configured to allow upward travel of the plurality of elevator cars;

a second hoistway configured to allow downward travel of the plurality of elevator cars;

an upper transfer station proximate a top of the first hoistway and the second hoistway; and a lower transfer station proximate a bottom of the first hoistway and the second hoistway;

wherein each of the plurality of elevator cars is moveable between the first hoistway and the second hoistway by way of each of the upper transfer station and the lower transfer station; and wherein movement of each of the plurality of elevator cars is controlled according to a predetermined assignment in which:

a plurality of floors is divided into a plurality of floor groups, each of the plurality of elevator cars is assigned to at least one of the plurality of floor groups, and each of the plurality of elevator cars is dispatched only to floors within the at least one floor group assigned thereto.

2. The ropeless elevator system of claim 1, wherein the predetermined assignment is dynamic.

3. The ropeless elevator system of claim 2, wherein the predetermined assignment comprises an initial assignment and at least one subsequent assignment.

4. The ropeless elevator system of claim 1, wherein each of the plurality of elevator cars has a control unit in communication with a control system, the control system programmed to dynamically assign each of the plurality of elevator cars for dispatching.

5. The ropeless elevator system of claim 1, further comprising at least one indicator that informs passengers which floors each of the plurality of elevator cars is assigned to.

6. The ropeless elevator system of claim 5, wherein the at least one indicator is selected from the group consisting of a display, a computer screen, a touchscreen, a tablet, a colored LED, an electronic sign, and an audio message.

7. The ropeless elevator system of claim 1, wherein the plurality of elevator cars comprises at least one special purpose car.

8. The ropeless elevator system of claim 1, wherein each elevator car includes a control unit, in communication with a control system to dispatch the plurality of elevator cars, each of the plurality of elevator cars is statically assigned to the predetermined assignment, and the control unit communicates to the control system the predetermined assignment.

9. The ropeless elevator system of claim 1, wherein the predetermined assignment includes a first elevator car assigned to stop at upper floors, and a second elevator car assigned to stop at lower floors.

10. A method for dispatching a plurality of elevator cars in an elevator system, the elevator system having a first hoistway configured to allow upward travel of the plurality of elevator cars, a second hoistway configured to allow downward travel of the plurality of elevator cars, an upper transfer station proximate a top of the first hoistway and the second hoistway, a lower transfer station proximate a bottom of the first hoistway and the second hoistway, and a control system communicating with a control unit positioned in each of the plurality of elevator cars, wherein each of the plurality of elevator cars is moveable between the first hoistway and the second hoistway by way of each of the upper transfer station and the lower transfer station, the method comprising:

dividing a plurality of floors into a plurality of floor groups;

assigning each of the plurality of elevator cars to at least one of the plurality of floor groups; and dispatching each of the plurality of elevator cars only to floors within the at least one floor group assigned thereto.

11. The method of claim 10, further comprising indicating to passengers the at least one floor group each of the plurality of elevator cars is assigned to.

12. The method of claim 11, wherein indicating to passengers the at least one floor group each of the plurality of elevator cars is assigned to includes using an indicator selected from the group consisting of a display, a computer screen, a touchscreen, a tablet, a colored LED, an electronic sign, and an audio message.

13. The method of claim 10, further comprising changing the at least one floor group assignment for at least one of the plurality of elevator cars.

14. The method of claim 10, further comprising assigning an elevator car as a special car for VIP service or cargo service.

15. The method of claim 10, further comprising determining an approximate number of passengers using the elevator system at each of the floors.

16. A ropeless elevator system, comprising:

an elevator car circulating in a loop to a plurality of floors, the loop including:

a first hoistway in which the elevator car travels upward, a second hoistway in which the elevator car travel downward, an upper transfer station positioned above the first hoistway and the second hoistway, and a lower transfer station positioned below the first hoistway and the second hoistway, the elevator car moveable between the first hoistway and the second hoistway when disposed in the upper or lower transfer station (34, 36);

a control unit mounted on the elevator car; and a control system in communication with the control unit, the control system programmed to:

assign the elevator car to a first group of floors according to a first assignment, send instructions to the control unit to dispatch the elevator car to the first group of floors, re-assign the elevator car to a second group of floors according to a second assignment, and send instructions to the control unit to dispatch the elevator car to the second group of floors.

17. The ropeless elevator system of claim 16, further comprising an indicator that conveys information to passengers of the group of floors the elevator car is assigned to.

18. The ropeless elevator system of claim 17, wherein the indicator is in communication with the control system and the control unit, and wherein the indicator changes the information it conveys to passengers when the elevator car is re-assigned to the second group of floors according to the second assignment.

19. The ropeless elevator system of claim 18, wherein the indicator is mounted on the elevator car or each of the floors.

20. The ropeless elevator system of claim 16, wherein the control system is further programmed to re-assign elevator car as a special car, dispatch the special car to a floor where it was called, and re-assign the special car back to the second group of floors according to the second assignment when the special car is empty of passengers.

* * * * *